US005300999A

United States Patent [19]

Koh et al.

[11] Patent Number: 5,300,999

[45] Date of Patent: Apr. 5, 1994

[54] IMAGE FIXING APPARATUS HAVING A FILM WITH IMPROVED SLIDEABILITY

[75] Inventors: Shokyo Koh, Yokohama; Yoshiyuki Koshimizu, Abiko; Yoshihiko Suzuki, Tokyo; Satoshi Mori, Yokohama; Koki Kuroda, Tokyo, all of Japan

[73] Assignee: Canon Kabushiki Kaisha, Tokyo, Japan

[21] Appl. No.: 972,731

[22] Filed: Nov. 6, 1992

Related U.S. Application Data

[63] Continuation of Ser. No. 637,120, Jan. 3, 1991, abandoned.

[30] Foreign Application Priority Data

Jan. 12, 1990 [JP] Japan ..... 2-005068
Jan. 12, 1990 [JP] Japan ..... 2-005838

[51] Int. Cl.[5] ..... G03G 15/20

[52] U.S. Cl. ..... 355/289; 219/469; 355/206; 355/290

[58] Field of Search ..... 355/285, 289, 290, 284, 355/283, 295, 206, 203; 219/216, 469, 470, 471, 546, 482, 388

[56] References Cited

U.S. PATENT DOCUMENTS

| | | | |
|---|---|---|---|
| 3,811,828 | 5/1974 | Ohta et al. | 219/216 X |
| 4,609,278 | 9/1986 | Taniguchi | 219/216 X |
| 4,737,818 | 4/1988 | Tanaka et al. | 219/216 X |
| 4,740,671 | 4/1988 | Kuroda et al. | 217/492 |
| 4,825,249 | 4/1989 | Oki et al. | 118/652 X |
| 4,925,583 | 5/1990 | Juhlke et al. | 252/58 |
| 4,954,845 | 9/1990 | Yano et al. | 355/290 |
| 4,996,125 | 2/1991 | Sakaguchi et al. | 430/66 |
| 5,043,763 | 8/1991 | Koh et al. | 355/206 |
| 5,115,278 | 5/1992 | Marula et al. | 355/285 |
| 5,118,920 | 6/1992 | Tanabe et al. | 219/216 |
| 5,162,634 | 11/1992 | Kusaka et al. | 219/216 |
| 5,179,263 | 1/1993 | Koh et al. | 219/216 X |

FOREIGN PATENT DOCUMENTS

| | | | |
|---|---|---|---|
| 0295901 | 12/1988 | European Pat. Off. . | |
| 0331075 | 9/1989 | European Pat. Off. | 355/289 |
| 2653486 | 6/1978 | Fed. Rep. of Germany . | |
| 60-104981 | 6/1985 | Japan . | |
| 63-064071 | 3/1988 | Japan . | |
| 1319080 | 12/1989 | Japan . | |

OTHER PUBLICATIONS

Xerox Disclosure Journal, "Solid State Release Agent System," vol. 13, No. 2, Mar./Apr. 1988.

*Primary Examiner*—A. T. Grimley
*Assistant Examiner*—T. Dang
*Attorney, Agent, or Firm*—Fitzpatrick, Cella, Harper & Scinto

[57] ABSTRACT

An image fixing apparatus includes a heater for producing heat upon electric power supply a film movable in sliding contact with the heater, wherein an unfixed toner image on a recording material is fixed by heat from the heater through the film; a temperature detecting element for detecting a temperature of the heater; wherein movement of the film is started when the temperature detected by the detecting element reaches a predetermined level.

26 Claims, 10 Drawing Sheets

IMAGE FIXING APPARATUS HAVING A FILM WITH IMPROVED SLIDEABILITY

This application is a continuation of application Ser. No. 07/637,120, filed Jan. 3, 1991, now abandoned.

FIELD OF THE INVENTION AND RELATED ART

The present invention relates to an image fixing apparatus for fixing an unfixed toner image on a recording material, more particularly to an image forming apparatus wherein the thermal energy is applied to the recording material from a heater through a heat resistive film.

As for an image fixing system for fixing a toner image on a recording material, a heat roller type fixing system is widely known. U.S. Ser. Nos. 206,767, now abandoned in favor of U.S. Ser. Nos. 668,333, 409,341, and U.S. Pat. Nos. 5,043,763, 416,539, now U.S. Pat. Nos. 4,998,121, 426,082, now U.S. Pat. Nos. 5,026,276, 435,247, now abandoned in favor of U.S. Ser. Nos. 735,709, 430,437, 440,380, now abandoned in favor of U.S. Ser. Nos. 751,571, 440,678, 444,802, and 446,449, now U.S. Pat. No. 5,027,160 which have been assigned to the assignee of this application, have proposed a novel image fixing apparatus which provides a solution to the problem with the heat-roller type fixing apparatus, that is, the long period that is required for warming up the fixing apparatus.

In the novel fixing apparatus, there is a heater having a low thermal capacity, fixed on a frame of the fixing apparatus, a film in sliding contact with the heater and a pressing roller for pressing the recording material to the film, by which the toner image is heated and pressed.

In such a fixing apparatus using the heater and the sliding film, the sliding of the film becomes an important factor for the load of the film driving.

Particularly, when the pressing roller applies pressure to the sliding portion, the sliding of the film constitutes the most part of the film drive load.

The fixing nip formed by the heater and the pressing roller with the film sandwiched therebetween acquires a high temperature due to the heating during the fixing. As a result, it is liable that the backside of the film (the side contacted to the heater) is adhered to the film sliding side of the heater in the fixing nip.

If this occurs, the film is stuck with the result of noise produced by the nip, or with the result that the film is not smoothly moved to disturb the image. If the film is adhered strongly, there is a significant torque increase upon the start of the film drive even to such an extent that the driving gear is partly damaged.

SUMMARY OF THE INVENTION

Accordingly, it is a principal object of the present invention to provide an image fixing apparatus wherein the torque required for driving the film in sliding contact with the heater is reduced.

It is another object of the present invention to provide an image fixing apparatus wherein the film is prevented from adhering to the heater.

It is a further object of the present invention to provide an image fixing apparatus wherein the time period from the start of the power supply to the heater to the start of the film drive is changed depending on the temperature.

It is a further object of the present invention to provide an image fixing apparatus wherein the film drive is started after the start of the power supply to the heater.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Referring to the accompanying drawings, the embodiments of the present invention will be described.

Figure 1:
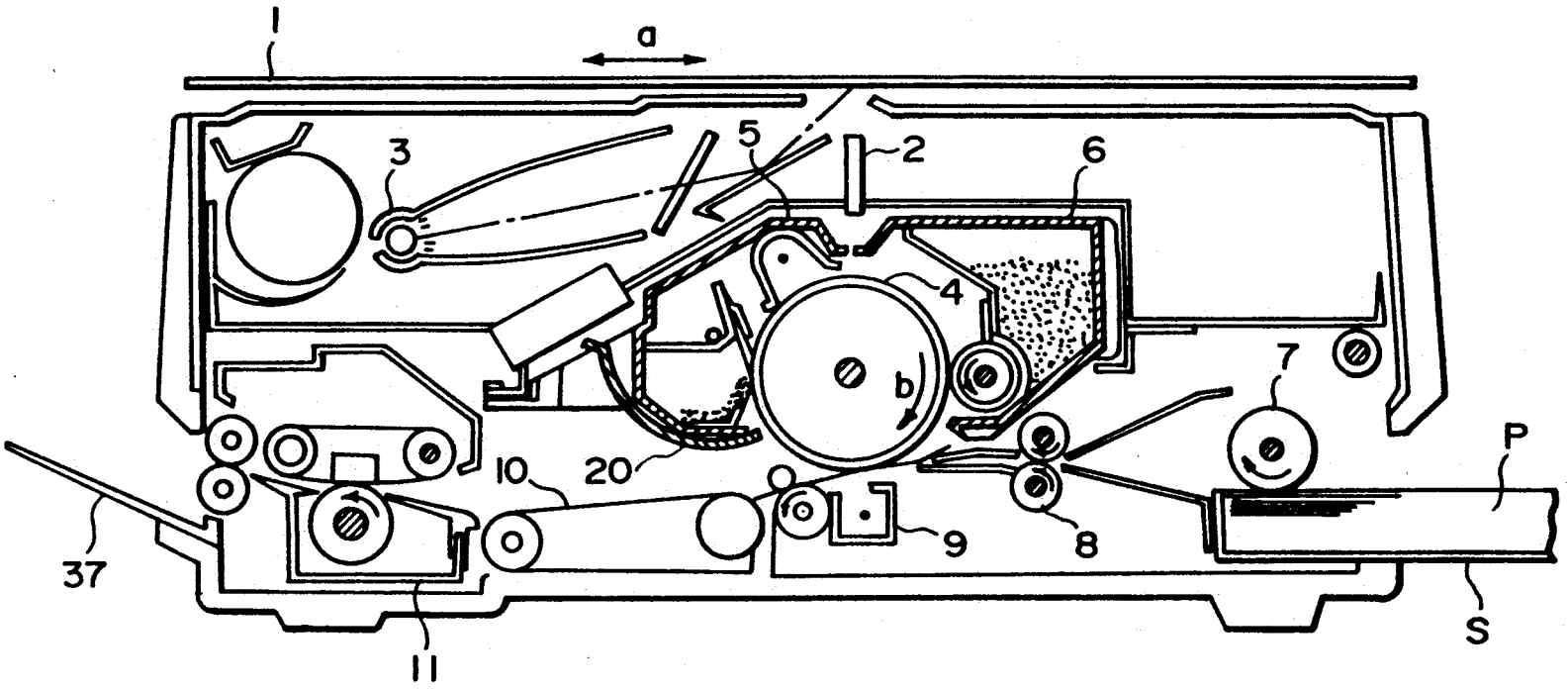
FIG. 1 is a sectional view of an image forming apparatus using the image fixing apparatus according to an embodiment of the present invention.

Referring first to FIG. 1, the image forming apparatus using the fixing apparatus according to an embodiment of the present invention will be described. It comprises an original supporting carriage made of transparent material such as glass and is reciprocable in the direction a to scan an original. Right below the original carriage, an array 2 of a short focus imaging elements is disposed. An original placed on the original carriage is illuminated by an illumination lamp 3, and the reflected light image is projected through a slit and through said array onto the photosensitive drum 4. The photosensitive drum rotates in the direction b. The photosensitive drum 4 has a zinc oxide photosensitive layer or organic photoconductor photosensitive layer or the like. A charger uniformly charges the surface of the photosensitive drum. The drum 4 thus uniformly charged by the charger is exposed to the image light through the array 2, so that an electrostatic latent image is formed. The latent image is visualized with a toner made of heat-softening or heat-fusible resin by a developing device. On the other hand, sheet P (recording material) accommodated in a cassette S is fed to the drum 4 by a pick-up roller 7 and registration rollers 8 rotated in synchronism with the image on the photosensitive drum 4. The toner image formed on the photosensitive drum 4 is transferred onto the sheet P by a transfer discharger 9. Thereafter, the sheet P is separated from the drum 4 by a known separating means, and is introduced along the conveying guide 10 into an image fixing apparatus 11 where it is subjected to the heat-fixing operation. Then, the sheet is discharged onto the tray 37. After the toner image has been transferred, the residual toner on the photosensitive drum is removed by the cleaner 20.

The description will be described as to the fixing apparatus.

Figure 2:
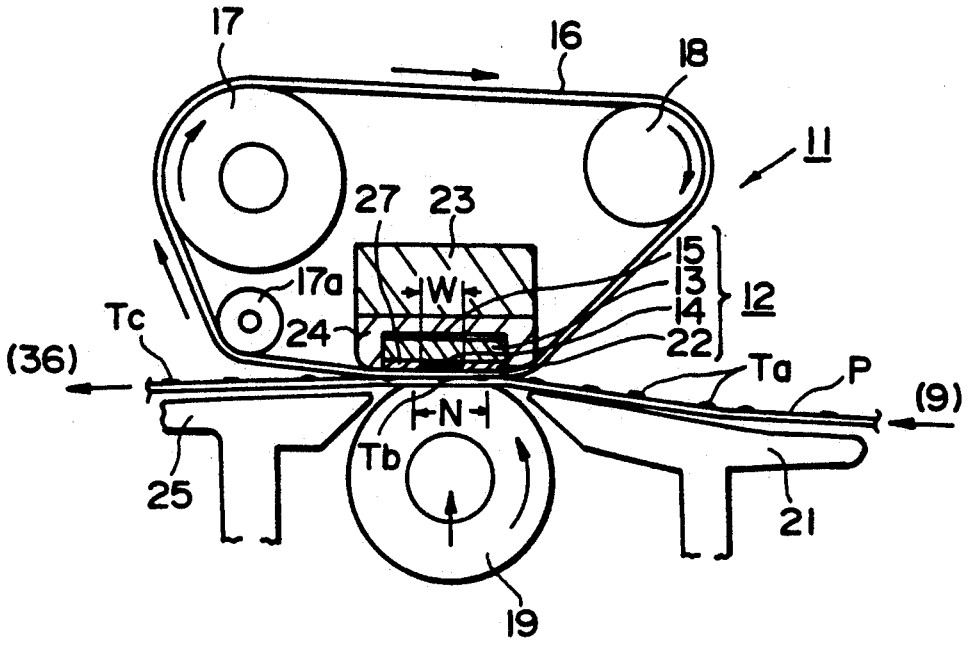
FIG. 2 is a sectional view of an image fixing apparatus according to an embodiment of the present invention.

FIG. 2 shows the general structure of a film-heating-type fixing apparatus 11 according to an embodiment of the present invention. It comprises a fixing film 16 in the form of an endless belt. The endless belt 16 is stretched around parallel four members 17, 18, 12 and 17*a*, namely, a driving roller 17 (left side), a follower roller 18 (right side) a heater 12 in the form of a line and having a low thermal capacity and disposed fixedly below a position between the rollers 17 and 18, and a guide roller 17*a* disposed below the driving roller 17.

The follower roller 18 also functions as a tension roller for stretching the endless belt 16. When the driving roller 17 rotates in the clockwise direction, the fixing film 16 also rotates in the clockwise direction at a predetermined peripheral speed, that is, the same peripheral speed as the transfer sheet P (image bearing member) having the unfixed toner image Ta conveyed from the image forming station 9. The fixing film is rotated without crease, snaking movement and without delay.

A pressing member 19 has a rubber elastic layer made of silicone rubber or the like having a good parting property. It cooperates with the bottom surface of the heater 11 to sandwich the bottom travel of the endless fixing film 16 with a total pressure of 4–7 kg, and it rotates codirectionally with the transfer sheet P, that is, in the counterclockwise direction.

The endless film 16 is repeatedly used for fixing the toner image, it has a heat resistivity, a parting property and durability. Generally, it has the thickness not more than 100 microns, preferably not more than 40 microns.

It may be a single layer film of a heat resistive resin having a thickness of 20 microns such as polyimide, polyether imide, PES (polyether sulfide), PFA (tetrafluoroethylene perfluoroalkylvinyl ether copolymer resin), or a multi-layer film comprising a film of 12 micron thickness and a coating layer of 10 micron thickness having good parting property at the image contactable side of the film, the coating layer being made of fluorinated resin such as PTFE (tetrafluoroethylene resin) or PFA added with conductive material.

The heater 12 of this embodiment comprises a heater supporting member 24 which is elongated in a direction perpendicular to the movement direction of the fixing film 16 and which has a high rigidity, high heat durability and heat insulating property. It also comprises a heat generating element 14 integrally mounted on the bottom side of the supporting member 24 and a temperature detecting element 15 for detecting the temperature of the heater 12 they constitutes a heater board 13.

The heater supporting member 24 has an insulating property and support the heater 12 to ensure the entire rigidity. It may be made of PPS (polyphenylene sulfide), PAI (polyamide imide), PI (polyamide), PEET (polyether ether ketone), liquid crystal polymer or another highly heat resistive resin, or a compound material of such resin and a ceramic material, metal or glass or the like.

The heater board 13 is made of good heat conductive material. For example, it is an alumina plate having a thickness of 1.0 mm, a width of 10 mm and a length of 240 mm.

The heat generating element 14 is made of $Ta_2N$, silver-palladium or another electric resistance material applied on the center of the bottom surface of the board 13 by screen printing or the like in the form of a line or a stripe having a width of 1.0 mm for example. It has a low thermal capacity and produces heat upon electric color supply thereto.

Temperature detecting element 15 is, for example, made of Pt film or the like having a low thermal capacity and applied by screen printing or the like on the top surface of the board 13 (opposite side from the heat generating element applied side) along the substantial center thereof. In this embodiment, the temperature detecting element 15 detects the temperature of the board 13 as the temperature of the heater 12.

The bottom surface of the heater 12, that is, the surface having the heat generating element 14 is contacted to the film. The surface is protected with a protection layer 22 made of glass covering the surface.

The heater 12 is bonded on the heater supporting member 24 having the heat insulating property with a heat resistive both sided tape or a heat resistive bonding agent. The supporting member 24 is fixedly mounted on a stay 23 of the fixing apparatus. The stay 23 is made of such a material and has such a structure that even if the heater 12 is pressed by the pressing roller 19, no significant deformation occurs at the longitudinal center thereof.

In this embodiment, the line or stripe heater generating element 14 is supplied with electric power by the electric connection at the opposite longitudinal ends to produce the heat over the entire length thereof. The electric power supply may be in the form of a pulse wave having a frequency of 20 msec. having 100 V. The electric power supply is controlled in accordance with the temperature detecting element 15 (which may be a thermister or the like) with the pulse width changed by a control circuit. The power supply compensates the energy emission. The pulse width is 0.5–5 msec. During the fixing operation, the power supply to said heater is controlled so that the temperature detecting element 15 detects a predetermined fixing temperature.

In this embodiment, a sheet sensor for detecting a leading and trailing edge of the sheet is disposed adjacent to the fixing apparatus 11 and upstream of the fixing apparatus 11 with respect to the conveyance direction of the transfer sheet, although the sensor is not shown in the Figure. In response to the detection by the sensor, the power supply period to the heat generating element 14 is limited to the duration in which the sheet is present in the fixing apparatus 11.

Upon the image formation start signal, the image forming apparatus produces an image on a transfer sheet at the transfer station 9. The transfer sheet P is conveyed from the transfer position 9 to the fixing apparatus 11 with the toner image Ta carried on its top surface. When the leading edge of the transfer sheet P is detected by the above-described unshown sensor, the fixing film 16 is started to rotate, and the transfer sheet P is guided by the guide 21 into the fixing nip N between the heater 12 and the pressing roller 19, more particularly, into the nip between the fixing film 16 and the pressing roller 19. It is moved together with the fixing film 16 with the unfixed toner image in contact with the fixing film 16 at the same speed as the conveying speed of the sheet P without the surface deviation or production of crease. In this manner, the transfer sheet is passed through the fixing nip N.

The heat generating element 14 at the bottom of the heater has a width w and is present within the width of the fixing nip, that is, the contact area between the bottom surface of the heater 12 and the top surface of the pressing roller 19.

When the toner image bearing surface of the sheet P is heated by the heat from the heat generating element 14 through the fixing film when the sheet P passes through the fixing nip with pressure-contact with the fixing film. By this, the powdery toner image on the sheet P is fused by the high temperature and is bonded on the surface of the sheet P as a softened image Tb.

In this apparatus, the sheet P is separated from the fixing film 16 at a point immediately after the fixing nip N. At this point of separation, the toner Tb has the temperature which is still higher than the glass transition point, and therefore, the toner Tb has a proper rubber nature, and therefore, the image surface upon separation does not follow the surface property of the fixing film, so that proper surface roughness is provided on the image surface. With the surface nature maintained, the toner image is cooled and solidified, and therefore, the resultant toner image is not too glossy, and therefore, the image quality is high.

The sheet P separated from the fixing film 16 is guided along the guide 25 and reaches the sheet discharging position. During this period, the toner temperature spontaneously decreases from the glass transition point to the point below the glass transition point, and is solidified into an image Pc. The sheet P having the fixed image is discharged. In this embodiment, a lubricant 27 is present between the bottom surface of the heater 12 at the fixing nip N, that is, the protection layer 22 of the heater 12 and the back side surface of the endless film 16, that is, the side thereof opposite from the toner contactable side thereof.

The lubricant 27 preferably has such a nature that even if it is used at a high temperature, it does not evaporate or deteriorate, and it does not deteriorate the member contacted, such as the rubber material of the driving roller 17 and the heat resistive supporting member 24 (usually made of heat resistive resin) or the like.

With the lubricant between the surface of the heater and the film surface, the protection layer 22 of the heater and the film 16 surface are not adhered, and the film 16 is always smoothly in sliding contact with the heater surface. Therefore, the noise or vibration is prevented from occurring.

The inventors' experiments and investigations on lubricant liquid or oil containing resin particles, more particularly, perfluoropolyether oil which is a fluorine oil containing PTFE resin particles have shown remarkable advantages. In the case of the lubricant oil containing the resin particles, even if the oil is evaporated by the heat of the heater 12 or the like, the resin particles contained in the oil remain between the heater 12 and the film 16, by which the friction resistance is reduced in the sliding contact region between the heater 12 and the film 16.

The lubricant 27 is applied on the bottom surface of the heater 12 during the manufacturing of the fixing apparatus.

Figure 3:
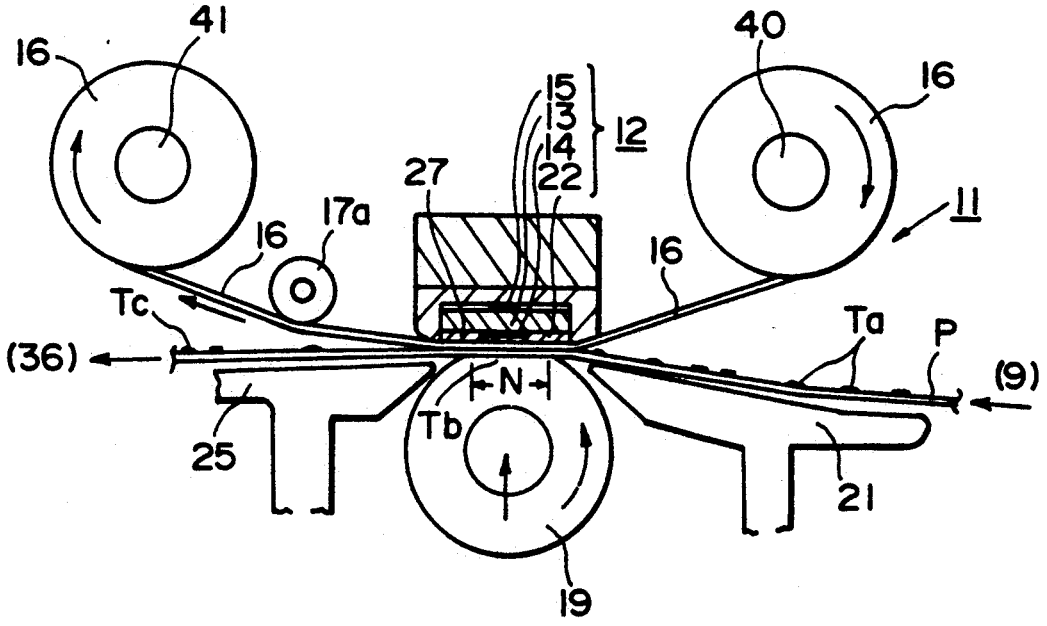
FIG. 3 is a sectional view of an image fixing apparatus according to another embodiment of the present invention.

In this embodiment, the description is made with respect to the fixing apparatus using the endless film. However, the fixing film 16 is not limited to the endless belt. As shown in FIG. 3, a rolled fixing film 16 may be in the form of a rolled film on a supply shaft 40. A leading end thereof is engaged on the take-up shaft 41 by way of the fixing nip between the heater 12 and the pressing roller 19 and by way of the bottom of the guide roller 17. In this case, the fixing film is moved at the same speed as the transfer sheet P. In this example, the lubricant 27 is present between the bottom surface of the heater 12 at the fixing nip N, that is, the protection layer 22 of the heater 12 and the back surface of the film 16, that is, the surface opposite from the toner image contactable size of the fixing film. The lubricant 27 may be applied to the bottom surface of the heater 12 during the manufacturing of the fixing apparatus.

Figure 4:
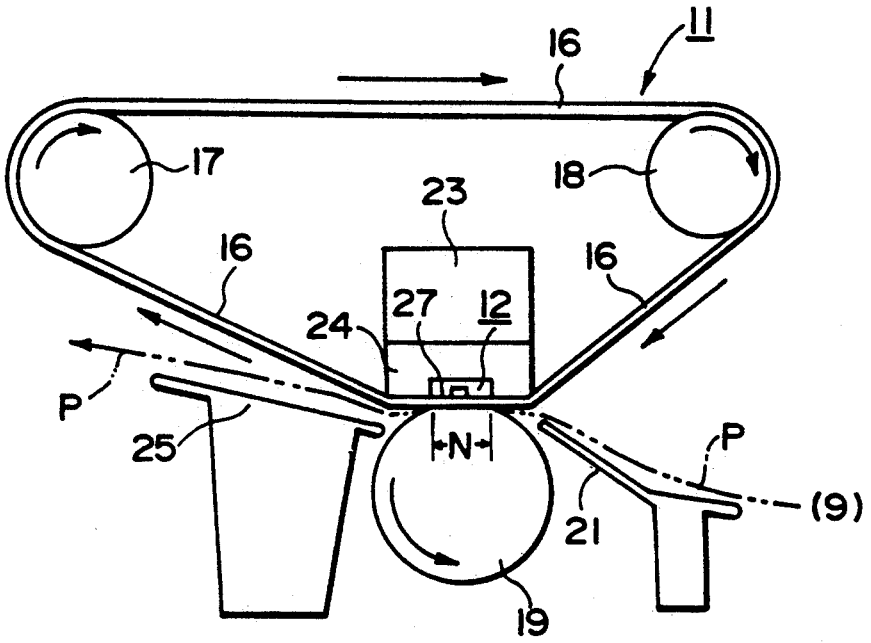
FIG. 4 is a sectional view of an image fixing apparatus according to a further embodiment of the present invention.

FIG. 4 shows an image fixing apparatus according to another embodiment. Similarly to the embodiment of FIG. 2, the fixing film 16 is in the form of an endless belt, but the present embodiment is different from FIG. 1 structure in the absent of the guide roller 17*a*.

In this example, the lubricant 27 is present between the bottom surface of the heater 12, that is, the protection layer 22 of the heater 12 at the fixing nip N and the backside of the fixing film 16, that is, the side opposite from the toner image contacting side. The lubricant 27 may be applied to the bottom surface of the heater 12 during the manufacturing of the fixing apparatus.

In the foregoing embodiments, the lubricant 27 is applied to the surface of the heater during the manufacturing of the apparatus, but in the case of a durable fixing apparatus, it is preferable that a lubricant supply device is used.

Figure 5:
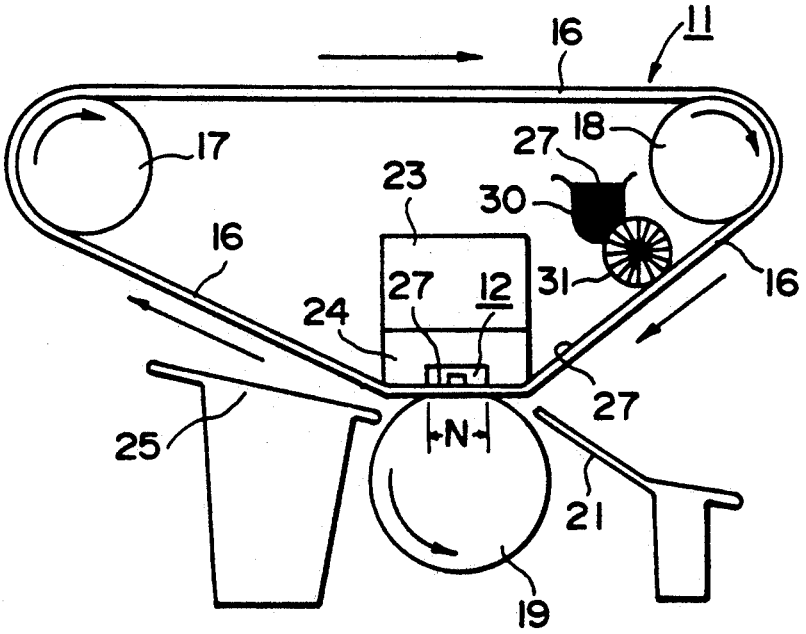
FIG. 5 is a sectional view of an image fixing apparatus according to a further embodiment of the present invention.

Referring to FIG. 5, an embodiment for this purpose will be described. The lubricant 27 is contained in a container 30 and is supplied to a grease applying roller 31 and is applied to the surface of the heat resistive endless film 16 which is opposite from the side contactable to the toner image (backside of the film). The roller 31 is effective to continuously feed the lubricant to the backside of the film. The lubricant 24 applied on the film backside present at the fixing nip N between the backside of the film and the bottom surface of the heater, so that the adherence between the surface of the heater and the film, and the stick-slip phenomenon can be prevented.

The position of the grease application roller 31 for supply the lubricant 27 is preferably upstream of the fixing nip N and downstream of the follower roller with respect to the movement direction of the film. By doing so, the excess lubricant is not applied to the driving roller, and in addition, since the film temperature is sufficiently low, the heat durability of the material of the roller 31 is not very severe, and therefore, a low cost material is usable therefor.

Figure 6:
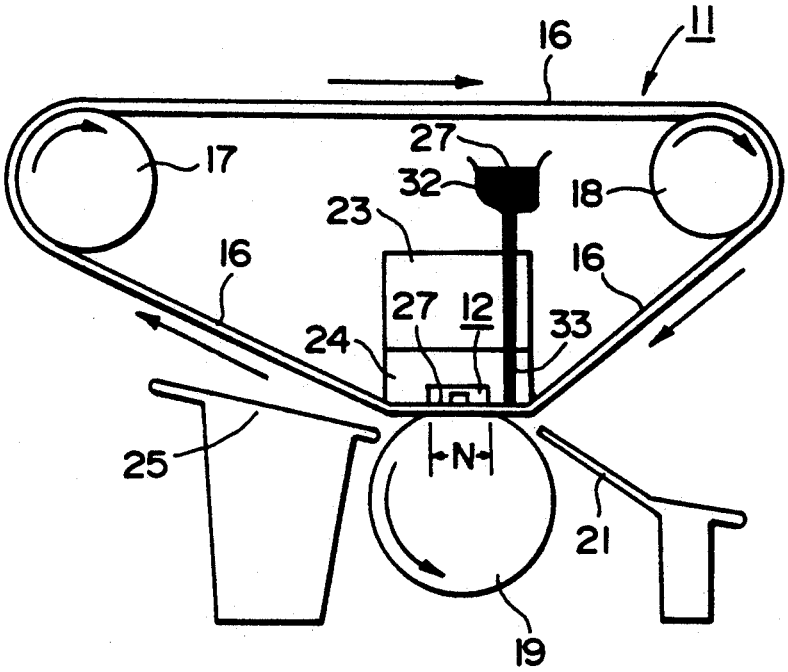
FIG. 6 is a sectional view of an image fixing apparatus according to a further embodiment of the present invention.

FIG. 6 shows another embodiment, wherein the position of the lubricant application is changed from that of FIG. 5. In the apparatus of this embodiment, the lubricant 27 in the container 32 is supplied to the backside of the film through a thin supply passage 33 formed in the heater supporting member 24 for supporting the heater 12 with heat insulation property, and through a small openings formed in the bottom surface of the supporting member upstream of the fixing nip N with respect to the film movement direction.

In this embodiment, the lubricant can be supplied without difficulty and with simple structure.

In the foregoing embodiments, when the lubricant is applied to between the heater 12 and the film 16, the load of the sliding movement of the film 16, that is, the frictional resistance between the heater 12 and the film 16 is higher when the temperature is low than when the temperature is high. This is because of the general characteristics of the lubricant grease, that is, the viscosity thereof increases with decrease of temperature.

Therefore, despite the use of the lubricant, a high output motor is required, or the power consumption is increased. When the temperature is very low, teeth or a tooth of the gear may be damaged with the result of damage to the driving gear train.

Figure 7:
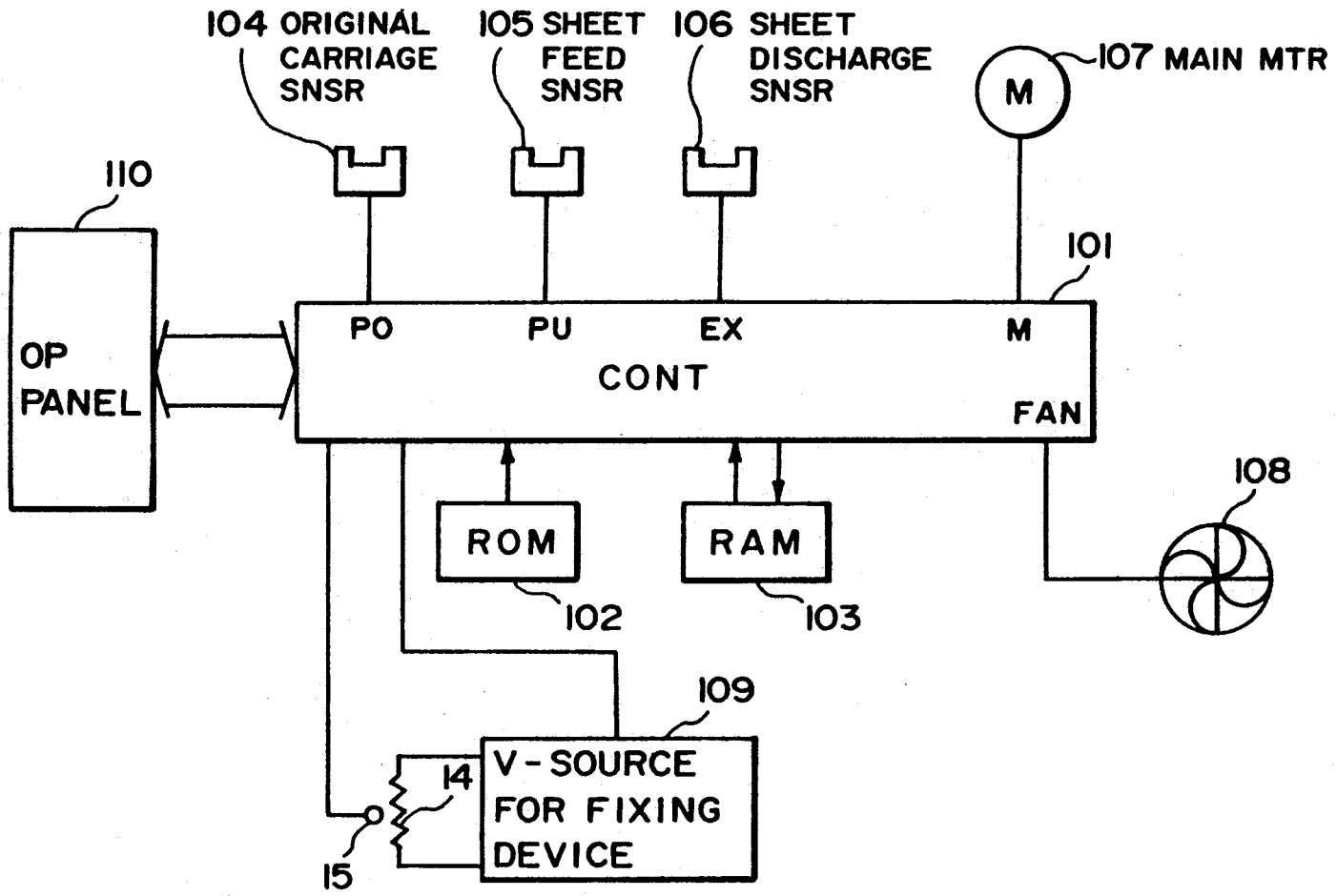
FIG. 7 is a block diagram of a control system for an image forming apparatus shown in FIG. 1.

Referring to FIG. 7, an embodiment wherein this problem is solved will be described.

FIG. 7 is a block diagram of a control system for an image forming apparatus shown in FIG. 1. A control circuit 101 includes a microcomputer or the like. The control system comprises ROM storing the controlling program and the control data, RAM 103 used for the control. Input ports PO, PU and EX of the control circuit receive sensor signals, and are connected with the original carriage position sensor 104, a sheet feed sensor 105 and a sheet discharge sensor 106, respectively. Each of the sensors comprises a photointerruptor and a light blocking member. When the light blocking member is detected, a high level is produced in the input ports PO, PU and EX.

A motor 107 driving signal is designated by a reference M. The main motor is operatively connected with the fixing film driving system, so that when the main motor is operated, the film is driven. To the control circuit 101, the operating portion 110 is connected to permit key input by the operator and the display are permitted.

Figure 8:
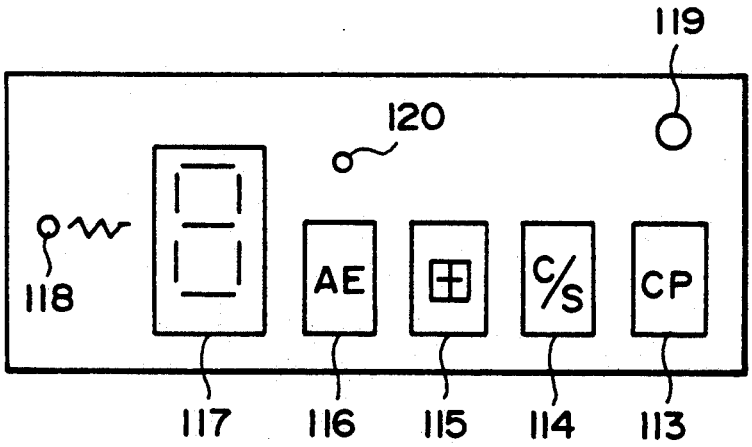
FIG. 8 is a top plan view of an operation panel of the image, forming apparatus shown in FIG. 1.

FIG. 8 illustrates an example of the operation. A power lamp 119 is always lit on during the power supply actuated. A jam lamp 118 displays malfunction of the apparatus such as paper jam. A 7-segment display 117 is cooperative with the jam lamp to display error, and displays numbers. Operation keys include a copy key 113, a clear key 114, an increment key 115 for setting the number of copies, an automatic exposure control key 116 for automatic image density control. An automatic exposure lamp 120 displays the automatic exposure operation.

In FIG. 7, reference numerals 14, 15 and 109 designate a fixing heater, a temperature detecting element such as a thermister for detecting the temperature of the heater and a circuit for supplying electric power to the heater. A reference numeral 108 designates a fan for discharging heat and air.

Figure 9:
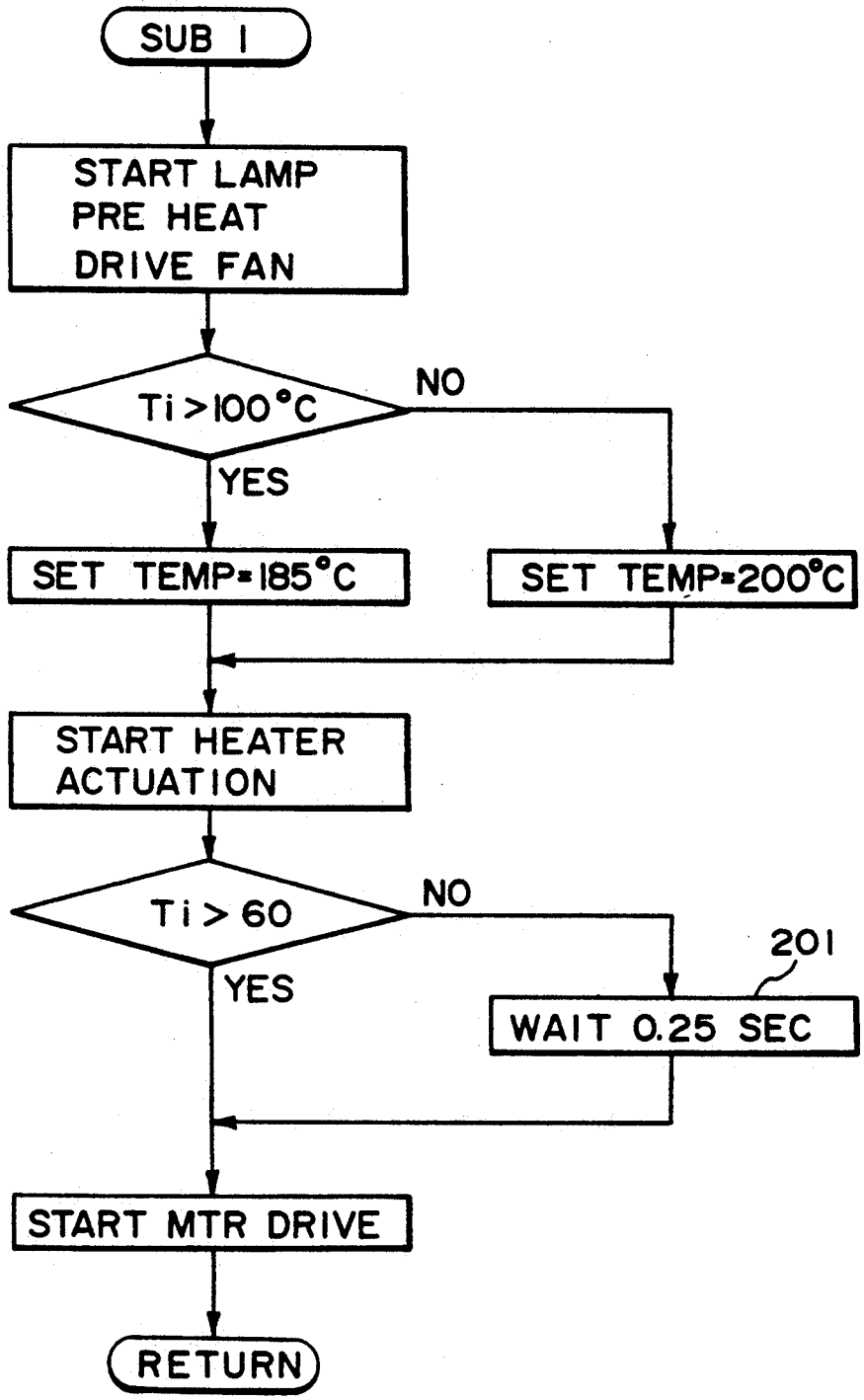
FIGS. 9, 10 and 11 are flow charts illustrating control operation according to a further embodiment of the present invention.
Figure 10:
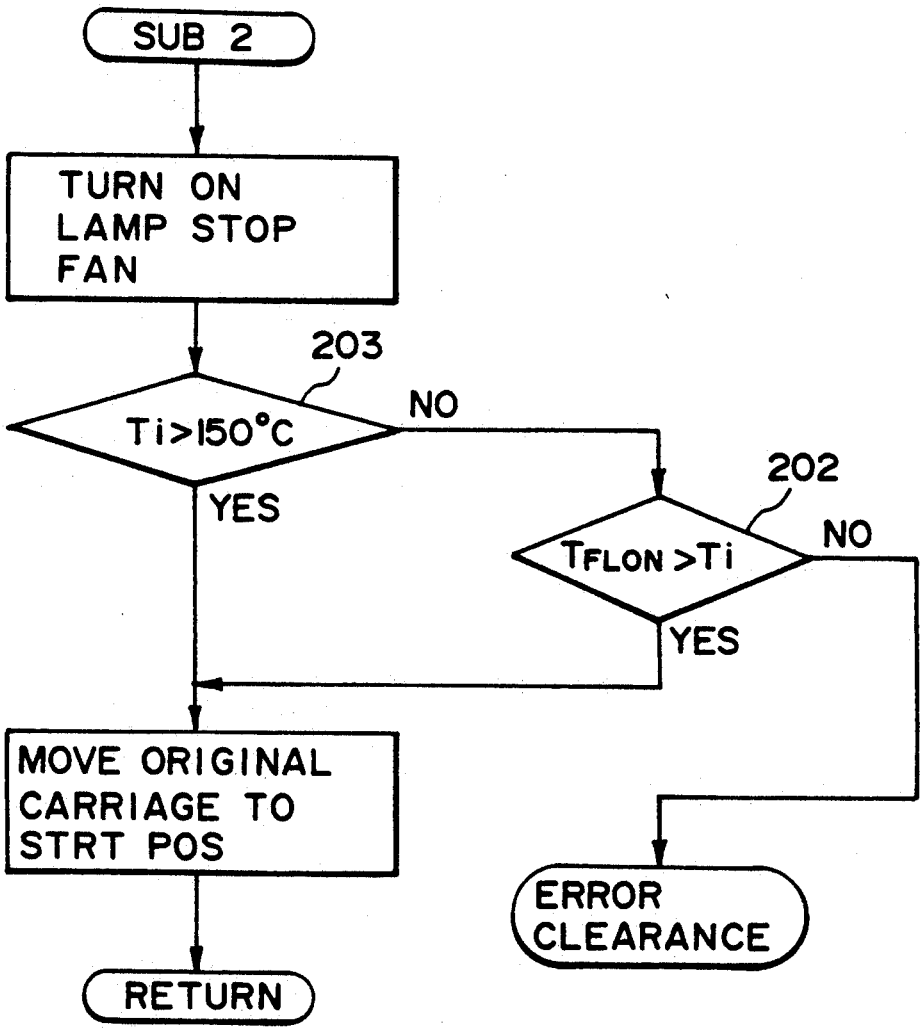
Figure 11:
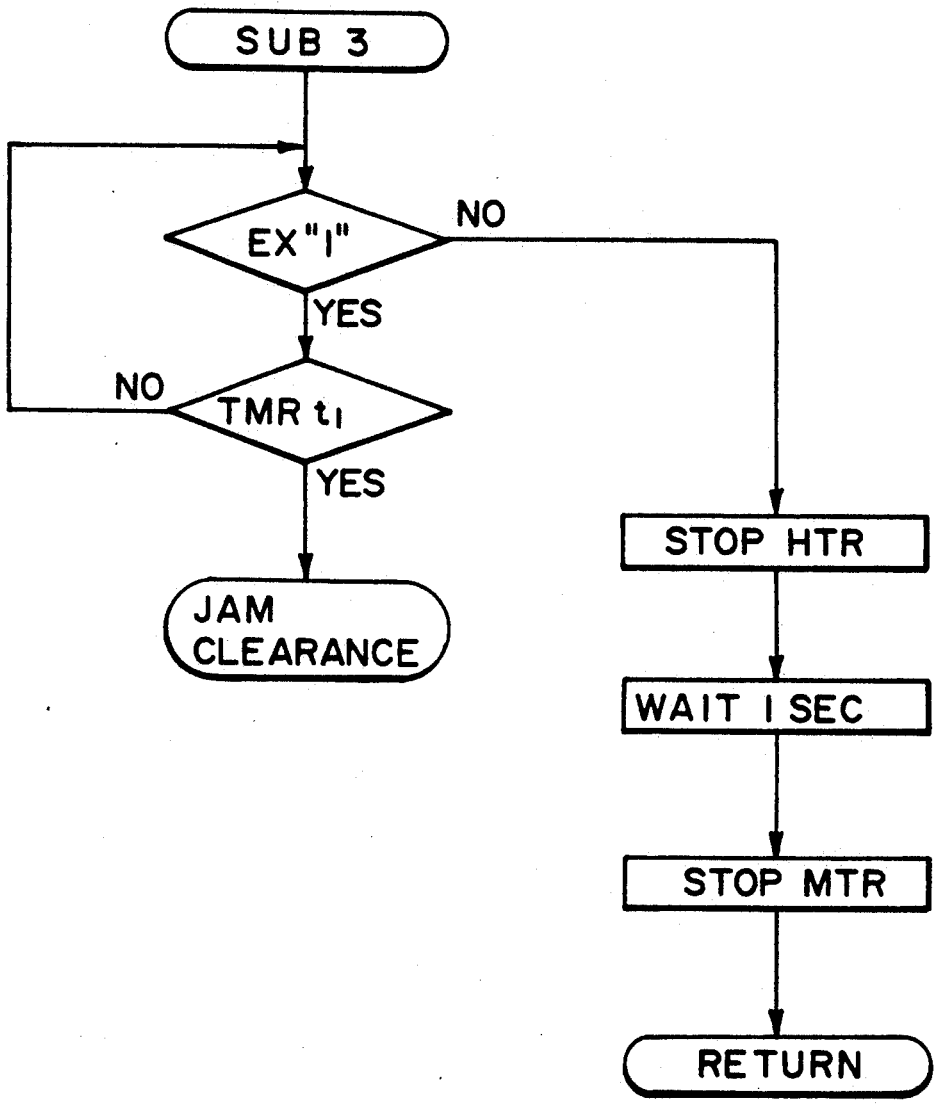

Referring to FIGS. 9, 10 and 11, the description will be made as to the operation of the control circuit 101. FIG. 9 represents a sub-routine accessed upon the start of the image forming operation after the copy key is actuated. In this sub-routine, the pre-heating is started to turn on the fluorescent lamp for illuminating the original. The temperature of the heater detected by the thermister 15 before the start of the power supply to the heat generating layer 14 after the copy key is actuated, is indicated by Ti. The discrimination is made as to whether the temperature Ti is higher or not than a first predetermined temperature. If it is lower, the setting temperature of the heater is selected to be 200° C., and when it is higher, it is selected to be 185° C., for example. The power supply to the heat generating layer 14 from the voltage source 109 is controlled so that the thermister 15 detects the selected temperature.

If the temperature Ti is higher than a second predetermined temperature, 60° C., for example, the main motor is actuated simultaneously with the start of the power supply to the heater. If it is lower, the main motor is driven 0.25 sec (201) after the start of the power supply to the heater.

By the delay of 0.25 sec, the temperature of the heater increases to above 60° C. (second predetermined temperature). When the lubricant is present (fluorine lubricating grease, in this embodiment) between the fixing film and the stationary heater, the difference in the required torques between the normal temperature and high temperature is large.

Since in the case that the heater is cold, the motor is driven to rotate the film only after the power supply to the heater is started, the surface of the heater is warmed, so that the viscosity of the lubricant can be lowered. By doing so, the frictional resistance between the surface of the heater and the fixing film 16 can be lowered. Therefore, the starting torque is reduced, and therefore, the capacity of the main motor can be lowered.

The required torque is 5.2 kg.cm at 20° C., 3.0 kg.cm at 100° C. and 1.8 kg.cm at 180° C., according to the experiments.

The starting torque is 2.5 kg.cm when the main motor is driven 0.25 sec after the start of the power supply to the heater, and is 40% lower than 4.0 kg.cm which is the starting torque when the power supply to the heater and the motor drive are simultaneously started.

The temperature Ti is stored in the RAM 103. Together with the power supply to the heater, the heat discharging fan in the image forming apparatus is driven.

After the execution of the sub-routine SUB1 is completed, the fluorescent lamp is turned on after a predetermined preheating period. Then, the copying operation is started. FIG. 10 shows the sub-routine accessed upon turning the fluorescent lamp on.

In SUB2, the fan being driven for the purpose of heat discharging is stopped, and the fluorescent lamp is turned on. By doing so, the air flow around the fluorescent lamp is stopped to assist the rising of the fluorescent lamp at the time of cold start. Then, the comparison is made between the temperature Ti stored in the RAM 103 and the current heater temperature TFLON, by which the malfunction is checked in the thermister or the heater (202). If the temperature Ti is higher than a third predetermined temperature, 150° C. for example, the processing of the step 202 is not performed (203). By changing the processing of malfunction discrimination depending on the temperature Ti, the erroneous discrimination of malfunction can be avoided even if the difference between the third predetermined temperature and the temperature Ti is small during correct operation. When the thermister and the heater are correctly operated, the original carriage is moved backwardly by an original carriage driving solenoid. The original carriage is placed at the start position using the original carriage position sensor 104. If the malfunction is discriminated, the copying operation is stopped, and the event is displayed on the 7-segment display or JAM lamp. After the quantity of light produced by the fluorescent lamp reaches a sufficient level, the fan is resumed to operate at a predetermined point of time, for example, at the time of high voltage output.

After the original carriage stops at the start position, the image forming operation is carried out through the copying process described hereinbefore.

After the copying process is completed, and the sheet discharge sensor 106 detects the sheet P discharged from the fixing apparatus. Then, the power supply to the heater is stopped, and the motor is stopped with delay of a predetermined period TO, 1 sec for example. Thus, the copying operation is completed (FIG. 11). In sub-routine SUB3 (FIG. 11), $t_1$ is the timer period for the jam detection due to delay of sheet discharge and is determined on the basis of the dimensions of the apparatus and the sheet conveying speed.

Figure 12:
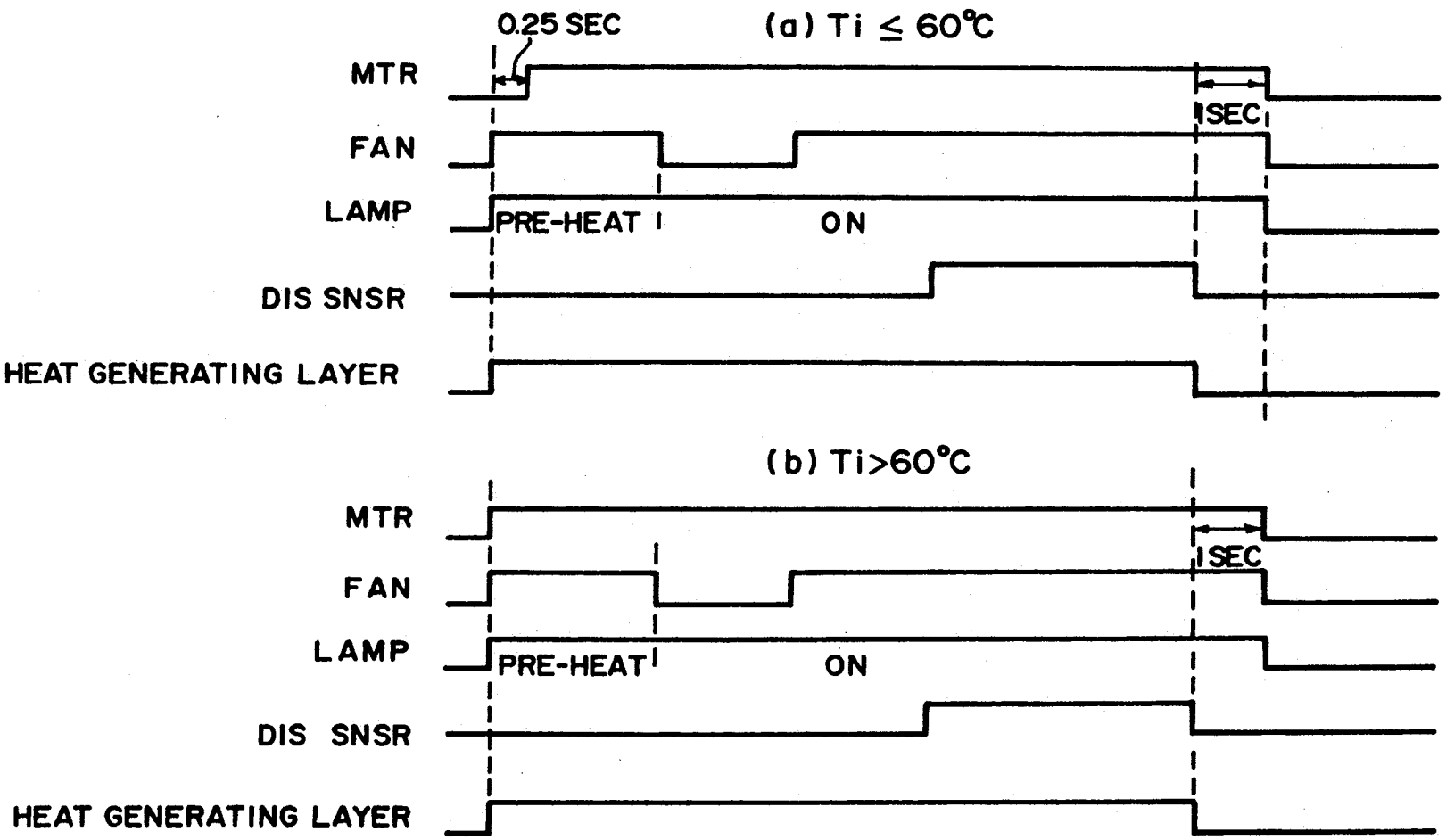
FIG. 12 is a timing chart in the operation of the apparatus shown in FIGS. 9–11.

FIG. 12 is a timing chart of the above-described operation. In this embodiment, the temperature detecting element 15 is used to detect the temperature of the heater 12, but the temperature detected by the element 15 is not limited to that of the heater 12, but may be the temperature showing the equivalent temperature change.

In this embodiment, the fixing film start timing is switched depending on the temperature Ti, but may be the fixing film may be started after a predetermined period elapses after the start of the power supply to the heater, independently of the temperature Ti.

A further embodiment will be described. In this embodiment, the film drive is started after the temperature of the heater increases to a predetermined level.

Figure 13:
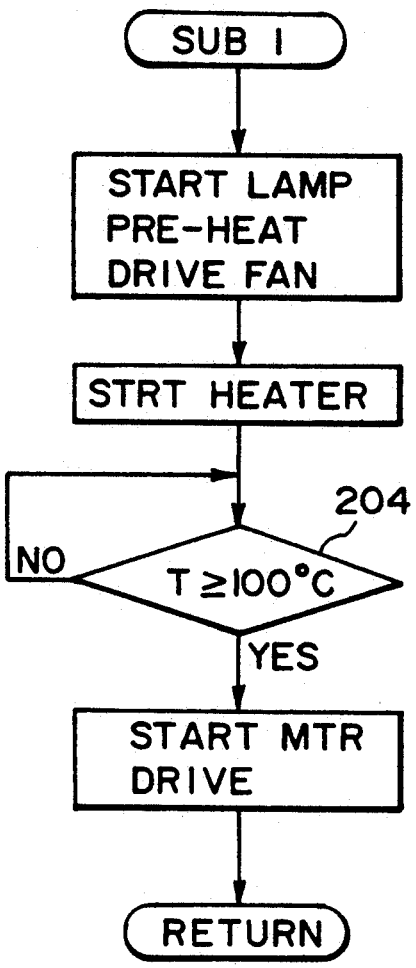
FIG. 13 is a flow chart according to a further embodiment of the present invention.

FIG. 13 illustrates this embodiment and shows a sub-routine of the control circuit 101 accessed upon copy button actuation. Similar to the sub-routine shown in FIG. 9, the pre-heating operation for the fluorescent lamp is started first. Thereafter, the electric power is supplied to the heat generating layer 14. When the thermister mounted on the heater detects a predetermined temperature T, for example, above 100° C. (204), the motor drive is started. The power supply to the heat generating layer is so controlled that the set temperature of 185° C., for example, is provided. As the previous embodiment, the temperature may be switched on the basis of the heater temperature Ti upon the copy button actuation (not shown).

A further embodiment will be described, in which the film drive is started either when the temperature of the heater reaches the predetermined level or when a predetermined period of time elapses from the starts of the power supply to the heater.

Figure 14:
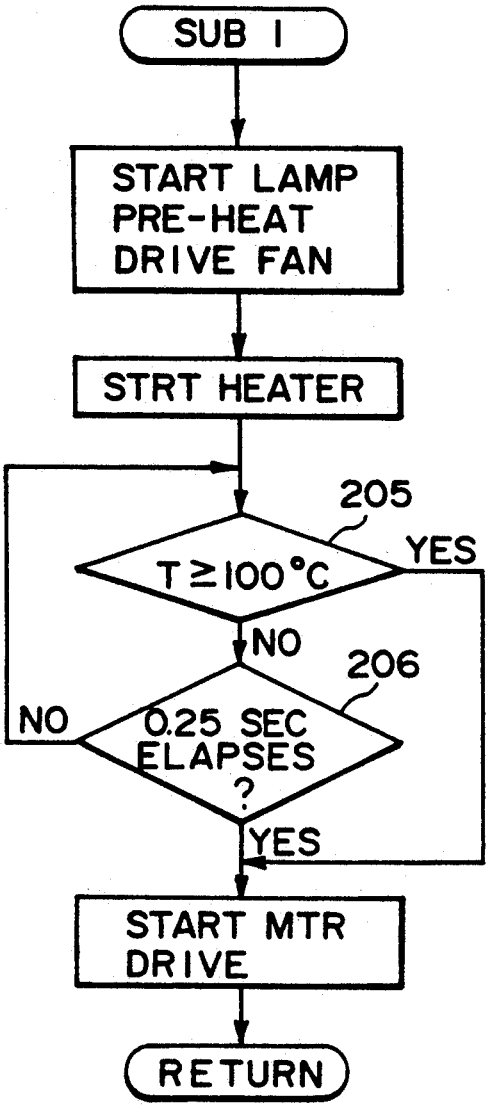
FIG. 14 is a flow chart of the operation of the apparatus according to a further embodiment of the present invention.

FIG. 14 shows the flow chart of this embodiment. FIG. 14 shows a sub-routine accessed upon the copy button actuation. Similar to the previous embodiments, the preheating operation is started to activate the fluorescent lamp. Thereafter, the heat generating layer 14 is supplied with electric power so as to increase the temperature to a predetermined set temperature. The main motor is started if either of the conditions are satisfied, the conditions being detection by the thermister of the temperature above a predetermined level (not less than 100° C.) (205) and elapse of 0.25 sec from the start of the power supply to the heater (206). In this embodiment, the temperature and the time elapse are checked. By doing so, it can be avoided that the fixing film is heated while not being moved, when the electric line of the thermister is opened, or the like. Therefore, the possibility of the damage to the film can be avoided. Similarly to the previous embodiment, the set temperature may be changed depending on the heater temperature Ti upon the copy button actuation.

In the foregoing embodiments, the description has been made as solving the problem when the lubricant is applied to between the heater 12 and the film 16. The frictional resistance between the heater 12 and the film which is resin coated at the sliding surface side is larger at low temperature than at high temperature, even if the lubricant is not used. Therefore, even if the lubricant is not applied, the performance of the above-describe sequential operation is preferable from the standpoint of reducing the film drive load.

The fixing apparatus according to this embodiment is usable with an image forming apparatus using toner, such as a copying machine, a printer or facsimile machine.

The present invention is not limited to such an image forming apparatus, but is applicable to a system wherein micro-capsule contained in the recording material or image transfer film is supplied with light or heat, by which color is produced to form an image. In this case, the image is improved or the image is fixed.

While the invention has been described with reference to the structures disclosed herein, it is not confined to the details set forth and this application is intended to cover such modifications or changes as may come within the purposes of the improvements or the scope of the following claims.

What is claimed is:

1. An image fixing apparatus, comprising:

a heater which is stationary in use for producing heat upon power supply thereto;

power supply control means for controlling power supply to said heater;

a film movable in sliding contact with said heater, wherein an unfixed toner image on a recording material is fixed by the heat from said heater through said film; and driving means for driving said film, wherein said control means starts power supply to said heater while the film is stationary, and said driving means starts driving of said film after the start of power supply to said heater.

2. An apparatus according to claim 1, wherein a sliding surface of said film in contact with said heater comprises a resin material, and the frictional resistance decreases by increase of temperature of said film by heat from said heater.

3. An apparatus according to claim 1, further comprising a lubricant oil present between said film and said heater, wherein the frictional resistance decreases by a rise in oil temperature and the resultant decrease in oil viscosity.

4. An apparatus according to claim 1, further comprising a temperature sensor for detecting temperature of said heater, wherein said driving means starts to drive said film when said temperature sensor detects a predetermined temperature.

5. An apparatus according to claim 1, wherein said driving means starts to drive said film a predetermined the period after start of power supply to said heater.

6. An apparatus according to claim 1, wherein said film is an endless belt.

7. An apparatus according to claim 1, wherein said film has a thickness of not more than 100 microns, preferably not more than 40 microns.

8. An apparatus according to claim 1, wherein there is no air layer between said heater and the toner image on the recording material.

9. An apparatus according to claim 1, further comprising a temperature sensor for detecting temperature of said heater and power supply control means for controlling power supply to said heater, so that said temperature sensor detects a constant temperature.

10. An image fixing apparatus, comprising:

a heater which is stationary in use for producing heat upon power supply thereto;

power supply control means for controlling power supply to said heater;

a film movable in sliding contact with said heater, wherein an unfixed toner image on a recording material is fixed by the heat from said heater through said film;

driving means for driving said film; and a temperature sensor for detecting a temperature of said heater, wherein said driving means increases, with a decrease of the temperature detected by said temperature sensor, an interval from a start of power supply to said heater by said control means to a start of the driving of said film by driving means.

11. An apparatus according to claim 10, wherein said driving means starts to drive said film simultaneously with start of power supply to said heater when said temperature sensor detects a temperature equal to or higher than a predetermined temperature, and when said temperature sensor detects a temperature less than the predetermined temperature, said driving means starts to drive said film upon detection of the predetermined temperature by said temperature sensor.

12. An apparatus according to claim 10, wherein a lubricant oil is present between said film and said hater.

13. An apparatus according to claim 10, wherein said film is an endless belt.

14. An apparatus according to claim 10, wherein said film has a thickness of not more than 100 microns, preferably not more than 40 microns.

15. An apparatus according to claim 10, wherein there is no air layer between said heater and the toner image on the recording material.

16. An image fixing apparatus, comprising:

a heater which is stationary in use for producing heat upon power supply thereto;

a film movable in sliding contact with said heater, wherein an unfixed toner image on a recording material is fixed by the heat from said heater through said film;

driving means for driving said film; and a fluorine-containing grease between said film and said heater.

17. An apparatus according to claim 16, wherein a viscosity of said grease decreases with a rise in temperature of said grease.

18. An apparatus according to claim 16, wherein said grease contains a resin powder.

19. An apparatus according to claim 18, wherein the resin powder is a fluorine resin.

20. An apparatus according to claim 19, wherein the fluorine resin is PTFE.

21. An apparatus according to claim 16, wherein said grease is perfluoropolyether oil.

22. An apparatus according to claim 16, wherein said film is an endless belt.

23. An apparatus according to claim 16, wherein said film has a thickness of not more than 100 microns, preferably not more than 40 microns.

24. An apparatus according to claim 16, wherein there is no air layer between said heater and the toner image on the recording material.

25. An apparatus according to claim 16, wherein said grease is applied during manufacturing of said apparatus.

26. An apparatus according to claim 16, further comprising supply means for supplying said grease to a sliding surface of said film.

* * * * *

UNITED STATES PATENT AND TRADEMARK OFFICE

CERTIFICATE OF CORRECTION

PATENT NO. : 5,300,999
DATED : April 5, 1994
INVENTOR(S) : SHOKYO KOH, ET AL.

It is certified that error appears in the above-indentified patent and that said Letters Patent is hereby corrected as shown below:

ON THE TITLE PAGE:
Item [56] References Cited, under U.S. Patent Documents, "Marula et al." should read --Maruta et al.--.
Item [57] Abstract, line 3, "supply" should read --supply--.

Column
Line ., "Similarly" should read --Similar--.

Column 9,
Line 68, "Similarly" should read --Similar--.

Column 10,
Line 62, "the" should read --time--.

Column 11,
Line 27, "driving means" should read --said driving means--; and
Line 39, "hater." should read --heater.--.

Signed and Sealed this
Eleventh Day of October, 1994

*Attest:*

*Attesting Officer*

Bruce Lehman

BRUCE LEHMAN

*Commissioner of Patents and Trademarks*